US006206503B1

(12) United States Patent
Kimura

(10) Patent No.: US 6,206,503 B1
(45) **Date of Patent: *Mar. 27, 2001**

(54) INKJET RECORDING HEAD

(75) Inventor: Shigeru Kimura, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,604

(22) Filed: Mar. 31, 1998

(30) Foreign Application Priority Data

Mar. 31, 1997 (JP) ..... 9-081268

(51) Int. Cl.[7] ..... B41J 2/21
(52) U.S. Cl. ..... 347/43; 347/40; 347/12
(58) Field of Search ..... 347/12, 15, 40, 347/41, 43, 47, 9

(56) References Cited

U.S. PATENT DOCUMENTS 5,654,744 * 8/1997 Nicoloff, Jr. et al. ..... 347/43
5,844,585 * 12/1998 Kurashima et al. ..... 347/40

FOREIGN PATENT DOCUMENTS

401216852 * 8/1989 (JP) ..... 347/40
3189167 8/1991 (JP) .
7-205454 8/1995 (JP) .
7-256874 9/1995 (JP) .

* cited by examiner

*Primary Examiner*—N. Le
*Assistant Examiner*—Lamson D. Nguyen
(74) *Attorney, Agent, or Firm*—Ostrolenk, Faber, Gerb & Soffen, LLP

(57) ABSTRACT

An inkjet recording apparatus includes a first unit, a second unit and a third unit. Each of the first to third units includes monochrome section and a different primary color section. The first to third units are integrated such that the monochrome sections are placed side-by-side and the primary color sections are placed side-by-side in a direction orthogonal to the line.

6 Claims, 3 Drawing Sheets

INKJET RECORDING HEAD

BACKGROUND OF THE INVENTION

1. Field of the Invention

The present invention relates to an apparatus employing an inkjet recording method, and more particularly to a recording apparatus for use in a printer for ejecting droplets from a nozzle to a recording medium.

2. Description of the Related Art

There has recently been a growing interest in non-impact printers, because noise while recording is extremely small to such a degree that it can be neglected. Particularly, inkjet printers are extremely effective in that they are structurally simple and that they can perform high-speed recording directly onto ordinary medium.

Inkjet printers fall into three broad categories: continuous type, on-demand (or impulse) type and electrostatic type. Among these types, the on-demand inkjet printer is provided with a lot of piezoelectric actuators which are selectively driven to eject ink droplets. Since a piezoelectric actuator ejects ink droplets on demand, it is possible to avoid needless ink consumption. Further, since the on-demand inkjet printer is structurally simple, it is expected to be widely used.

Recently, a color printer has been commercially available and the quality of color print is becoming increasingly higher. For a color inkjet head for use in such a color printer, it is very important to eliminate bleeding due to a combination of black and color nozzles.

In Japanese Patent Unexamined Publication No. 7-205454, an inkjet printer has been disclosed in which, to eliminate the bleeding when printing, an array of black nozzles is provided at a distance from other arrays of color nozzles. More specifically, the black nozzle array is placed such that it performs ink ejection in a scan line preceding that of the color nozzle arrays.

Since the black nozzle array and the color nozzle arrays are separately provided within a single head, however, it is difficult to miniaturize the inkjet head and further accurate positioning and high integration techniques are needed.

As another example of prior art, there has been disclosed an inkjet head in Japanese Patent Unexamined Publication No. 7-256874. This conventional inkjet head is provided with a plurality of arrays of nozzles wherein the upper half of a specific array is used for black ink and the respective lower halves of other arrays are used for different color inks; Yellow (Y), Magenta (M) and Cyan (Cy).

However, the lower half of the specific array and the respective upper halves of the other arrays are not used at all. Therefore, unused nozzles are easily clogged, resulting in deteriorated quality of printing.

SUMMARY OF THE INVENTION

It is an objective of the present invention to provide an inkjet recording apparatus which can achieve enhanced miniaturization and high reliability of printing.

According to the present invention, the apparatus includes first to third units which are integrated.

The first unit has a first monochrome section comprising a plurality of first monochrome nozzles and a first primary color section comprising a plurality of first primary color nozzles, wherein the first monochrome nozzles and the first primary color nozzles are arranged in a line.

The second unit has a second monochrome section comprising a plurality of second monochrome nozzles and a second primary color section comprising a plurality of second primary color nozzles, wherein the second monochrome nozzles and the second primary color nozzles are arranged in a line.

The third unit has a third monochrome section comprising a plurality of third monochrome nozzles and a third primary color section comprising a plurality of third primary color nozzles, wherein the third monochrome nozzles and the third primary color nozzles are arranged in a line.

The first to third units are integrated such that the first to third monochrome sections are placed side-by-side and the first to third primary color sections are placed side-by-side in a direction orthogonal to the line.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENT

Figure 1:
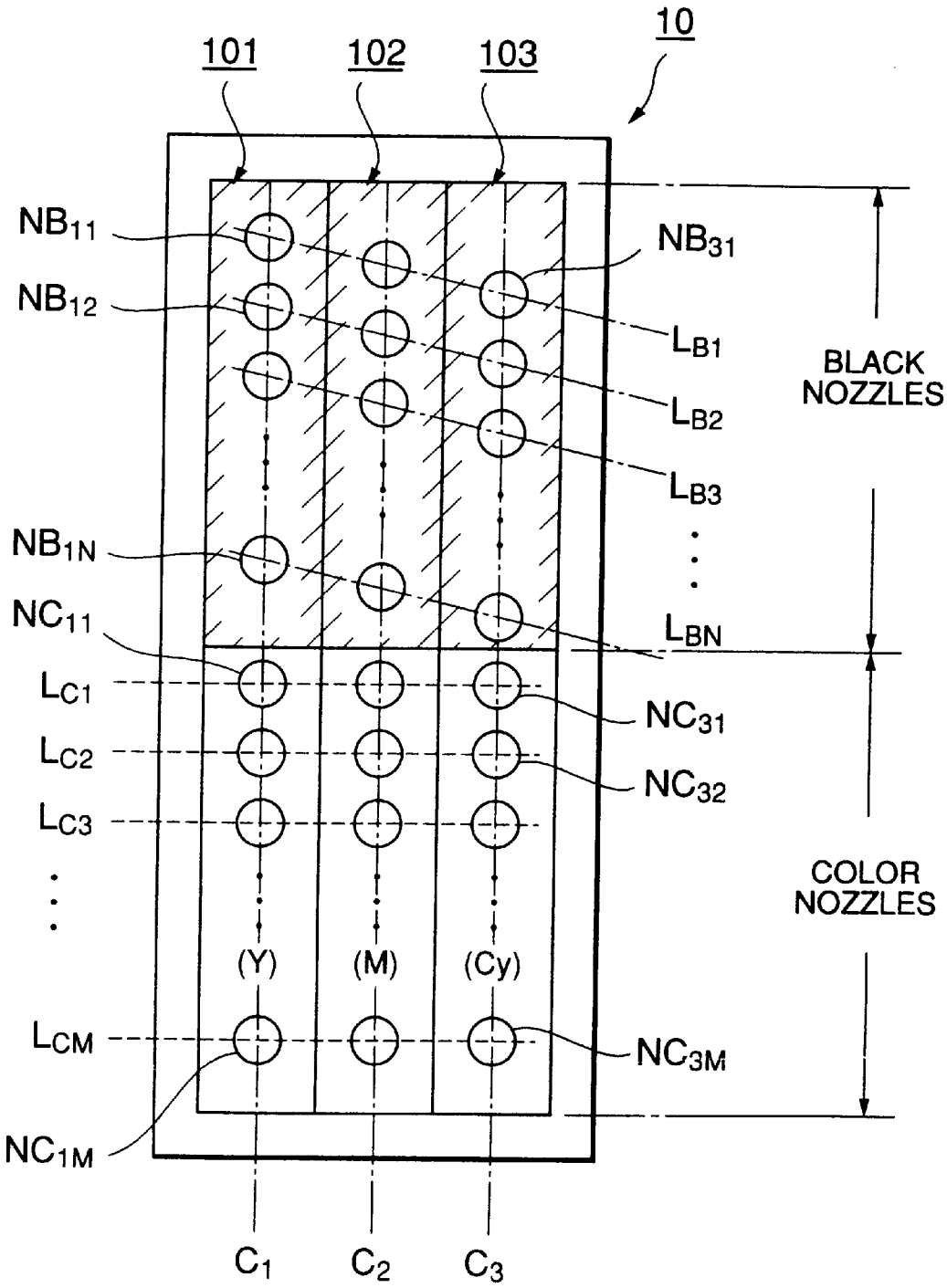
FIG. 1 is a front view of an inkjet head according to an embodiment of the present invention.

Referring to FIG. 1, an inkjet head according to an embodiment of the present invention is comprised of three head chips 101–103 each having a predetermined number (N+M) of nozzles which are arranged in a line. More specifically, the first head chip 101 has N+M nozzles arranged in a line $C_1$ which consist of N black nozzles $NB_{11}$–$NB_{1N}$ spaced uniformly and M yellow (Y) nozzles $NC_{11}$–$NC_{1M}$ spaced uniformly. The second head chip 102 has N+M nozzles arranged in a line $C_2$, which consist of N black nozzles $NB_{21}$–$NB_{2N}$ spaced uniformly and M magenta (M) nozzles $NC_{21}$–$NC_{2M}$ spaced uniformly. The third head chip 103 has N+M nozzles arranged in a line $C_3$, which consist of N black nozzles $NB_{31}$–$NB_{3N}$ spaced uniformly and M cyan (Cy) nozzles $NC_{31}$–$NC_{3M}$ spaced uniformly. The lines $C_1$–$C_3$ are spaced uniformly and parallel to each other.

Further, the color nozzles $NC_{11}$–$NC_{31}$ over three head chips 101–103 are arranged in a line $L_{C1}$ orthogonal to the lines $C_1$–$C_3$. Similarly, color nozzles $NC_{12}$–$NC_{32}$, $NC_{13}$–$NC_{33}$, . . . , and $NC_{1M}$–$NC_{3M}$ are arranged in lines $L_{C2}$–$L_{CM}$, respectively. The lines $L_{C1}$–$L_{CM}$ are spaced uniformly and parallel to each other.

Furthermore, the black nozzles $NB_{11}$–$NB_{31}$ over three head chips 101–103 are arranged in a line $L_{B1}$ crossing each of the lines $C_1$–$C_3$ at an angle. Similarly, black nozzles $NB_{12}$–$NB_{32}$, $NB_{13}$–$NB_{33}$, . . . , and $NB_{1N}$–$NB_{3N}$ are arranged in lines $L_{B2}$–$L_{BN}$, respectively. The lines $L_{B1}$–$L_{BN}$ are spaced uniformly and parallel to each other. The angle of tilt of lines $L_{B1}$–$L_{BN}$ is determined such that a combination of black nozzles of three head chips 101–103 provides three times as high as the black resolution of each head chip. Therefore, in the case of monochrome printing, only one scan of the inkjet head in the direction orthogonal to the lines $C_1$–$C_3$ causes the monochrome image to be provided with the predetermined resolution.

Figure 2A:
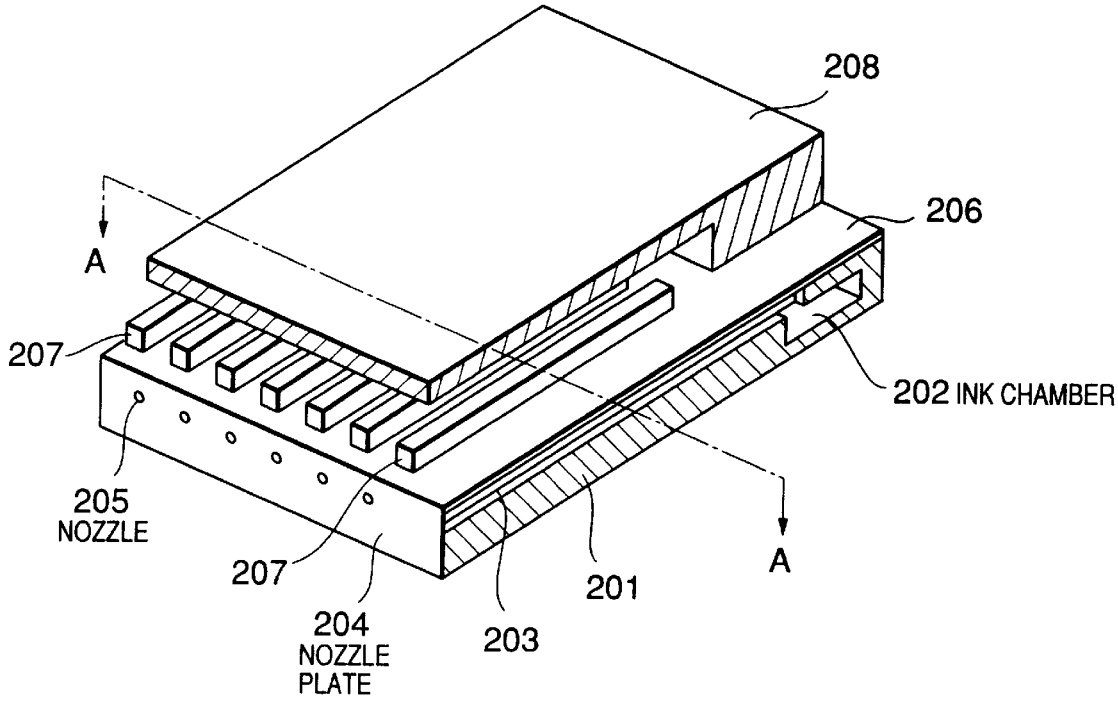
FIG. 2A is a perspective and partial cutaway view of a head chip of the inkjet head as shown in FIG. 1.
Figure 2B:
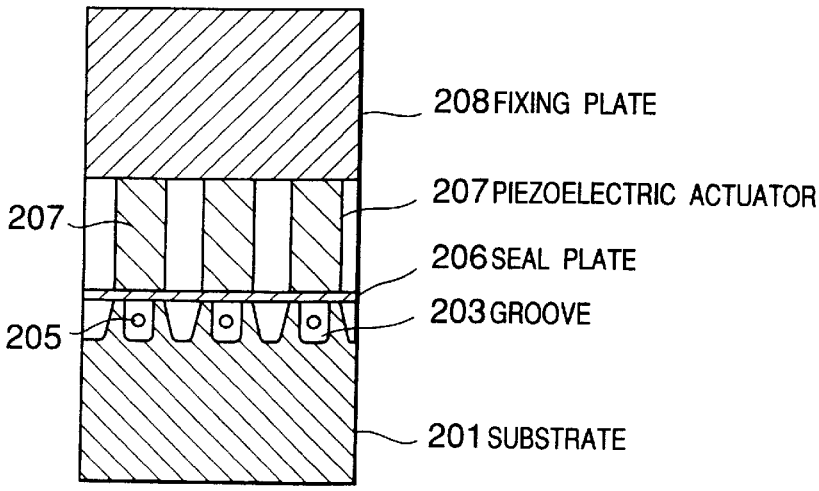
FIG. 2B is a cross-sectional view taken on line A—A of FIG. 2A.

Referring to FIGS. 2A and 2B, there is shown an example of a single head chip of the inkjet head. A substrate 201 is provided with black and color ink chambers 202 and black and color ink-flowing grooves 203. In this embodiment, the ink chambers 202 consist of black ink chamber and color ink chamber (yellow, magenta or cyan) and the black and color ink-flowing grooves 203 extend from the corresponding ink chamber to the front end of the substrate 201 on the substrate 201. Therefore, ink flows through the corresponding ink-flowing grooves 203. A nozzle plate 204 is placed at the front end of the substrate 201 and has N+M nozzles 205 corresponding to the ink-flowing grooves 203, respectively.

The surface of the substrate 201 having the grooves 203 formed thereon is covered with a seal plate 206 on which N+M piezoelectric actuators 207 are placed corresponding to the ink-flowing grooves 203. The piezoelectric actuators 207 are fixed to a fixing plate 208. In such a structure, when a selected piezoelectric actuator 207 is driven, the corresponding ink-flowing groove is compressed to push the ink to the corresponding nozzle from which droplets are jetted.

The inkjet head as shown in FIG. 1 is formed with a combination of three head chips 101-103 each having the structure as shown in FIGS. 2A and 2B. Another type of head chip may be employed which has the ink-flowing grooves formed within an piezoelectric device.

Figure 3:
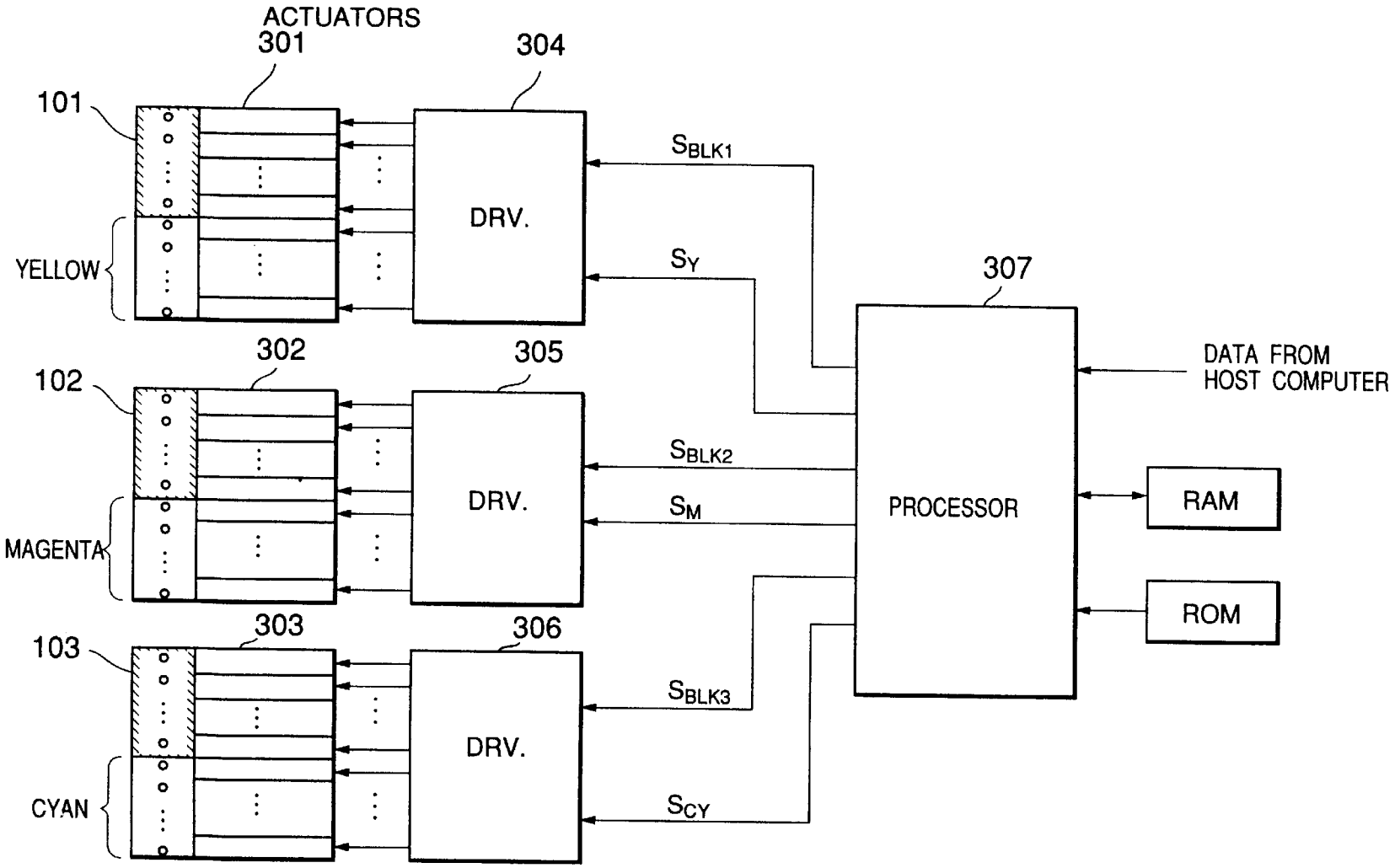
FIG. 3 is a block diagram showing a circuit configuration of an inkjet printer employing the embodiment of FIG. 1.

Referring to FIG. 3, an inkjet printer is provided with the inkjet head including the head chips 101-103. The head chip 101 has piezoelectric actuators 301 corresponding to the nozzles, respectively. As described above, the nozzles of the head chip 101 consist of N black nozzles $NB_{11}$–$NB_{1N}$ and M yellow (Y) nozzles $NC_{11}$–$NC_{1M}$. Similarly, the head chip 102 has piezoelectric actuators 302 corresponding to the black and magenta nozzles, respectively, and the head chip 103 has piezoelectric actuators 303 corresponding to the black and cyan nozzles, respectively. The piezoelectric actuators 301 are driven by a driver 304, and similarly, other piezoelectric actuators 302 and 303 are driven by drivers 305 and 304, respectively.

When receiving control data and print data from a host computer (not shown), a microprocessor 307 analyzes the data to produce nozzle selection data. The selection data for black nozzle, $S_{BLK1}$–$S_{BLK3}$, are output to the drivers 304–306, respectively. The selection data for Y, M and Cy nozzles, $S_Y$, $S_M$, and $S_{Cy}$, are output to the drivers 304–306, respectively.

In the case of monochrome printing, the microprocessor 307 uses the black nozzles of all head chips by providing black nozzle selection data $S_{BLK1}$–$S_{BLK3}$ to the driver 304–306, respectively.

In the case of color printing, the microprocessor 307 uses the black nozzles of a selected head chip and selected color nozzles by providing black nozzle selection data and color nozzle selection data to the driver 304–306, respectively.

What is claimed is:

1. An apparatus for selectively ejecting droplets from a plurality of nozzles, comprising:

a first unit having a first monochrome section comprising a plurality of first monochrome nozzles and a first primary color section comprising a plurality of first primary color nozzles, the first monochrome nozzles and the first primary color nozzles being arranged in a first line;

a second unit having a second monochrome section comprising a plurality of second monochrome nozzles and a second primary color section comprising a plurality of second primary color nozzles, the second monochrome nozzles and the second primary color nozzles being arranged in a second line; and a third unit having a third monochrome section comprising a plurality of third monochrome nozzles and a third primary color section comprising a plurality of third primary color nozzles, the third monochrome nozzles and the third primary color nozzles being arranged in a third line, wherein the first, second and third lines are parallel, wherein the first, second and third units are integrated such that the monochrome nozzles of the first, second and third monochrome sections form a first plurality of rows that are non-orthogonal to the first, second and third lines, and wherein the color nozzles of the first, second and third primary color sections form a second plurality of rows that are orthogonal to the first, second and third lines and wherein the monochrome nozzles of the first, second and third lines are each arranged with a predetermined nozzle pitch with respect to the nozzles in the same monochrome section and wherein the non-orthogonal rows are formed by displacing the monochrome nozzles of the second line in the direction of the second line by a distance equal to one third of the predetermined nozzle pitch and by displacing the monochrome nozzles of the third line in the direction of the third line by a distance equal to two thirds of the predetermined nozzle pitch to thereby provide three times a monochrome resolution of each of the first, second and third monochrome sections.

2. The apparatus according to claim 1, wherein the first to third monochrome nozzles are used for black ink ejection, the first primary color nozzles are used for yellow ink ejection, the second primary color nozzles are used for magenta ink ejection, and the third primary color nozzles are used for cyan ink ejection.

3. An inkjet printer comprising:

an inkjet head for selectively ejection droplets from a plurality of nozzles to a recording medium; and a controller controlling the inkjet head depending on input print data, the inkjet head comprising:

a first unit having a first monochrome section comprising a plurality of first monochrome nozzles and a first primary color section comprising a plurality of first primary color nozzles, the first monochrome nozzles and the first primary color nozzles being arranged in a first line;

a second unit having a second monochrome section comprising a plurality of second monochrome nozzles and a second primary color section comprising a plurality of second primary color nozzles, the second monochrome nozzles and the second primary color nozzles being arranged in a second line; and a third unit having a third monochrome section comprising a plurality of third monochrome nozzles and a third primary color section comprising a plurality of third primary color nozzles, the third monochrome nozzles and the third primary color nozzles being arranged in a third line, wherein the first, second and third lines are parallel, wherein the first, second and third units are integrated such that the monochrome nozzles of the first, second and third monochrome sections form a first plurality of rows that are non-orthogonal to the first, second and third lines, and wherein the color nozzles of the first, second and third primary color sections form a second plurality of rows that are orthogonal to the first, second and third lines and wherein the monochrome nozzles of the first, second and third lines are each arranged with a predetermined nozzle pitch with respect to the nozzles in the same monochrome section and wherein the non-orthogonal rows are formed by displacing the monochrome nozzles of the second line in the direction of the second line by a distance equal to one third of the predetermined nozzle pitch and by displacing the monochrome nozzles of the third line in the direction of the third line by a distance equal to two thirds of the predetermined nozzle pitch to thereby provide three times a monochrome resolution of each of the first, second and third monochrome sections.

4. The inkjet printer according to claim 3, wherein, when monochrome printing is performed, the controller controls the inkjet head such that the first to third monochrome sections are all used.

5. The inkjet printer according to claim 3, wherein, when color printing is performed, the controller controls the inkjet head such that one of the first to third monochrome sections is used and the first to third primary color sections are used.

6. The inkjet printer according to claim 3, wherein the first to third monochrome nozzles are used for black ink ejection, the first primary color nozzles are used for yellow ink ejection, the second primary color nozzles are used for magenta ink ejection, and the third primary color nozzles are used for cyan ink ejection.

* * * * *